United States Patent [19]

Heinze et al.

[11] Patent Number: 4,672,689

[45] Date of Patent: Jun. 16, 1987

[54] WATER SAVING TOILET SYSTEM

[75] Inventors: Walter O. Heinze, Swathmore, Pa.; Wesley M. Tufts, Holliston, Mass.

[73] Assignee: Control Fluidics, Inc., Greenwich, Conn.

[21] Appl. No.: 320,457

[22] Filed: Nov. 12, 1981

Related U.S. Application Data

[62] Division of Ser. No. 147,484, May 7, 1980, Pat. No. 4,333,185.

[51] Int. Cl.[4] ..... E03D 1/00

[52] U.S. Cl. ..... 4/415; 4/319; 4/320; 4/661; 210/138

[58] Field of Search ..... 4/319, 300, 320, 321, 4/323, 415, 661, 317; 210/805, 86, 138, 142

[56] References Cited

U.S. PATENT DOCUMENTS

| | | | |
|---|---|---|---|
| 1,996,325 | 4/1935 | Cox | 4/320 X |
| 2,718,012 | 9/1955 | Howe | 4/319 |
| 3,094,707 | 6/1963 | Fleming | 4/319 |
| 3,699,592 | 10/1972 | Minchak | 4/320 |
| 3,713,177 | 1/1973 | Tufts et al. | 4/320 |
| 3,878,569 | 4/1975 | Peivish et al. | 4/319 |
| 4,012,322 | 3/1977 | Saigh et al. | 210/86 |
| 4,131,959 | 1/1979 | Albertassi | 4/319 |
| 4,170,798 | 10/1979 | Krumdieck | 4/319 |

*Primary Examiner*—Henry K. Artis

*Attorney, Agent, or Firm*—Robert T. Gammons

[57] ABSTRACT

A toilet system comprising a bowl, a valve for supplying flush water to the bowl, an attrition chamber to which the effluent in the bowl is transferred by a motor-driven discharge pump connected to the attrition chamber for inducting the effluent from the bowl into the attrition chamber and discharging the treated effluent from the attrition chamber, a power-driven hydraulic attrition impeller within the attrition chamber for effecting hydraulic attrition of the solid matter in the effluent while in the attrition chamber, and a control circuit for effecting sequential operation such that discharge and attrition are commenced substantially simultaneously, followed by introduction of flush water, termination of the discharge, termination of the flush water and, finally termination of the attrition.

9 Claims, 21 Drawing Figures

WATER SAVING TOILET SYSTEM

This is a division of application Ser. No. 147,484 filed May 7, 1980, now U.S. Pat. No. 4,333,185.

BACKGROUND OF INVENTION

Toilet systems for disposal of human waste of conventional construction use an excessive amount of water. It is estimated that a typical family uses as much as 36,000 gallons of water per year solely for flushing toilets. The annual use of water for toilet purposes of 100,000 families would total 3,600,000,000 gallons. The use of such a large quantity of water for toilet purposes creates a shortage of water for other purposes, for example, agricultural and industrial purposes and constitutes a tremendous problem with respect to disposal by existing methods. Discharging such volumes of waste into the sea or on land through filter beds, cesspools and the like has caused much concern since large volumes of effluent create both ecological and health hazards. Additionally, the cost of disposal is high. It is, accordingly, the purpose of this invention to provide a toilet system which can be flushed with a minimum volume of water not only to save the water, but to reduce the volume of water which must be disposed of.

SUMMARY OF INVENTION

As herein illustrated, the water saving toilet comprises a bowl, means for supplying fluid to the top of the bowl, a discharge port at the bottom, an attrition chamber containing a hydraulic attrition impeller, conductor means connecting the port at the bottom of the bowl to the attrition chamber, said attrition chamber having a discharge port, and means for inducting the effluent from the bowl into the attrition chamber and simultaneously discharging treated effluent from the attrition chamber into waste disposal system via piping, container or other disposal means. The means for supplying the water to the bowl is a control valve connecting the bowl to a source of water and means for effecting its operation and the means for conducting the effluent from the bowl into the attrition chamber is a pump having an intake side connected to the attrition chamber and a discharge side connected to a disposal system. The valve, hydraulic attrition impeller and pump are operable in conjunction to supply a predetermined volume of fluid to the bowl, discharge a coresponding volume of treated effluent from the attrition chamber and induct a corresponding volume of effluent from the bowl into the attrition chamber. The valve, pump and hydraulic attrition impeller are power driven and there is a control system for effecting their operation to start the pump and hydraulic attrition impeller prior to actuating the valve, stop the pump before deactivating the valve and stop the hydraulic attrition impeller after deactivating the valve. Optionally, a monitor in the form of a pressure transducer which senses the water pressure controls the valve to assure an optimum flush water level and, optionally, a pulsator is interposed in the conductor operable to effect pulsation of the water delivered to the bowl. The bowl may optionally be provided with a well at the bottom within which is located the discharge port. In one form, there are ports spaced peripherally about the top of the bowl through which water is supplied to the bowl and these are positioned to direct the flush water downwardly toward the discharge port. In lieu of or in addition to the ports, a spray head may be provided at the front of the bowl in a position to direct a sheet of water downwardly on the bottom and side walls of the bowl. Optionally, there is provided at the bottom of the bowl an auxiliary flush port to assist in discharging the fluid through the discharge port. The discharge port of the bowl is connected by a conductor to the attrition chamber designed to maintain a predetermined level of water in the bowl. Desirably, the conductor is designed to minimize the hydraulic head. Two to three inches of fluid suffice to maintain a seal. Desirably, the conductor is elliptical at its place of attachment to the discharge port from the bowl and is circular at its place of attachment to the inlet opening to the attrition chamber. A portion of the bottom of the attrition chamber is toroidal and the hydraulic attrition impeller is a disk-shaped blade designed to effect dissemination of the effluent by hydraulic attrition. The blade is supported in concentric relation to the toroidal portion of the bottom for rotation about an axis perpendicular thereto. The power-driven pump is preferably a displacement-type pump, but not limited thereto, and there are intake and discharge valves connecting the intake and discharge ports of the pump, respectively, with the discharge port of the attrition chamber and a conductor for conducting the treated effluent through a secondary conductor hose system. The secondary conductor provides a seal between the toilet system and the sewer system so that the modular components can be easily removed and replaced. Detachable fittings connect the power-driven pump to the intake and discharge valves and to enable easily removing the pump. The hydraulic attrition impeller together with the means for driving it are removably secured into the top of the attrition chamber to enable removal for cleaning.

The invention is considered also to reside in a method of disposing of effluent in a toilet system with a minimum expenditure of flush water wherein the toilet system comprises a bowl, means for supplying flush water to the bowl, an attrition chamber to which the effluent in the bowl is transferred by a pump connected to the attrition chamber and a hydraulic attrition impeller within the tank for effecting hydraulic attrition of the solid matter of the effluent comprising maintaining a predetermined level of water in the bowl and a predetermined level of effluent in the attrition chamber and controlling operation of the means for supplying fluid to the bowl and the pump to deliver a predetermined volume of fluid to the bowl and discharge a corresponding volume of effluent from the attrition chamber. Desirably, with this method, discharge of the effluent from the attrition chamber is commenced before supplying flush water to the bowl and terminated before termination of the flush water. Dissemination may be initiated simultaneously with the discharge and desirably is continued until after termination of the delivery of flush water to the bowl. The discharge is effected according to this method by employing a pump having its intake side connected to the attrition chamber so as to withdraw the effluent from both the bowl and the attrition chamber during the suction stroke and discharge the effluent to a discharge line on the pressure stroke.

The invention will now be described in greater detail with reference to the accompanying drawings, wherein.

Figure 1:
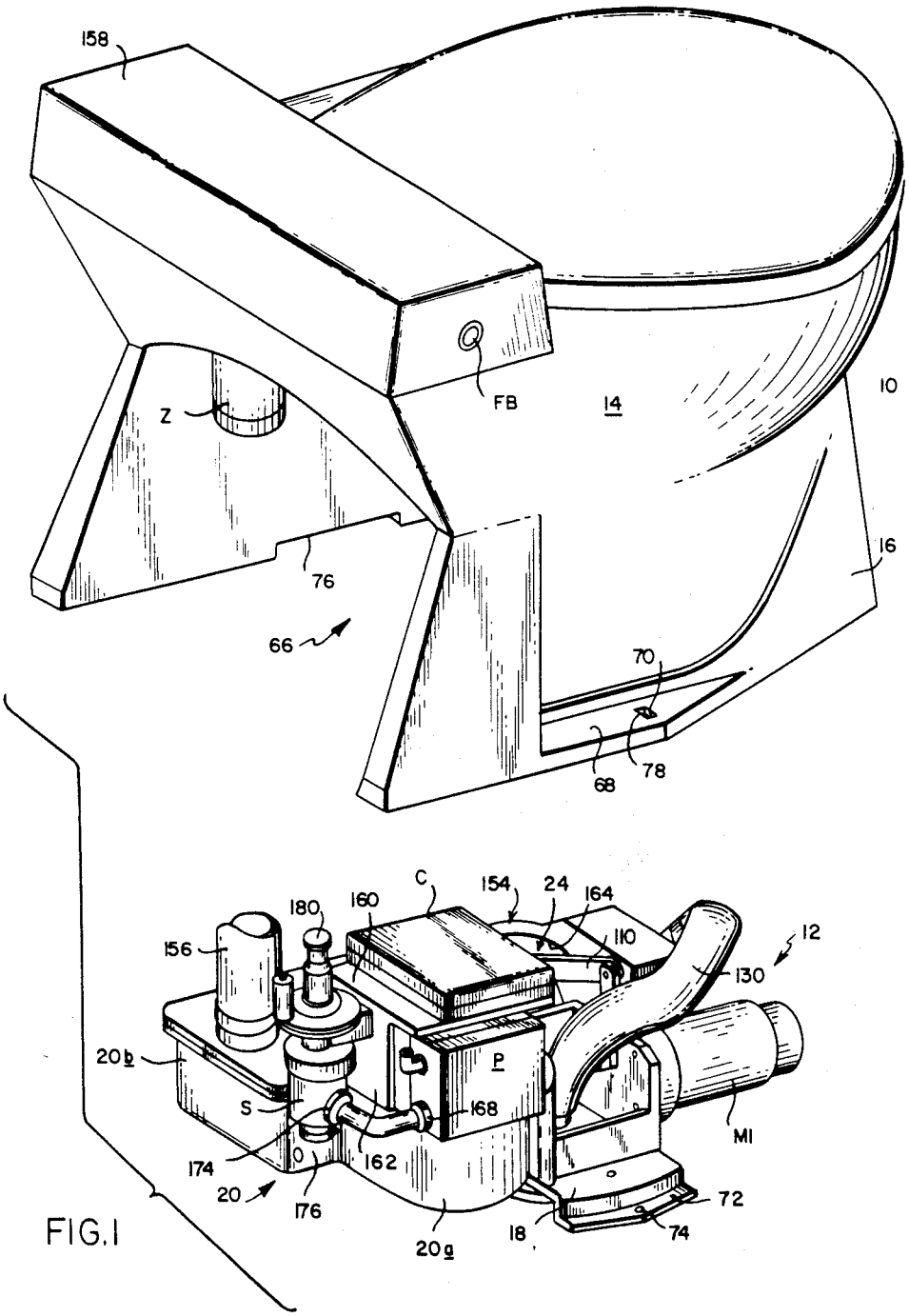
FIG. 1 is a perspective of the water saving toilet of this invention showing the toilet bowl and support therefor, the latter defining an enclosure for housing the operating components with the operating components removed therefrom.
Figure 5:
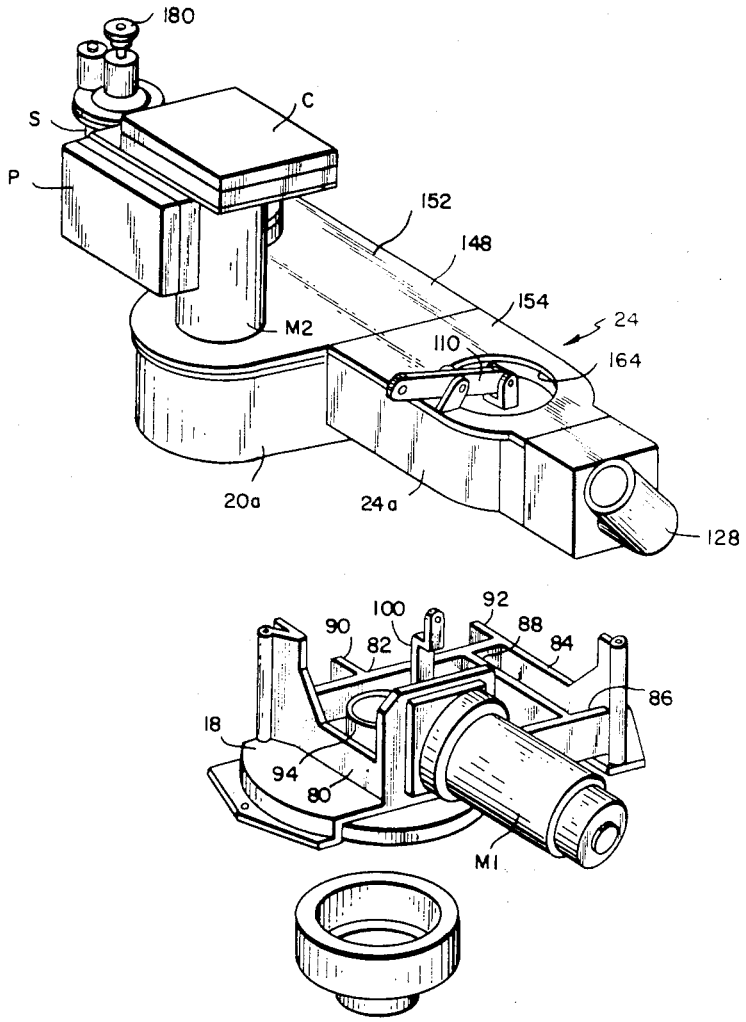
FIG. 5 is a perspective of the components of the assembly separated from each other.
Figure 7:
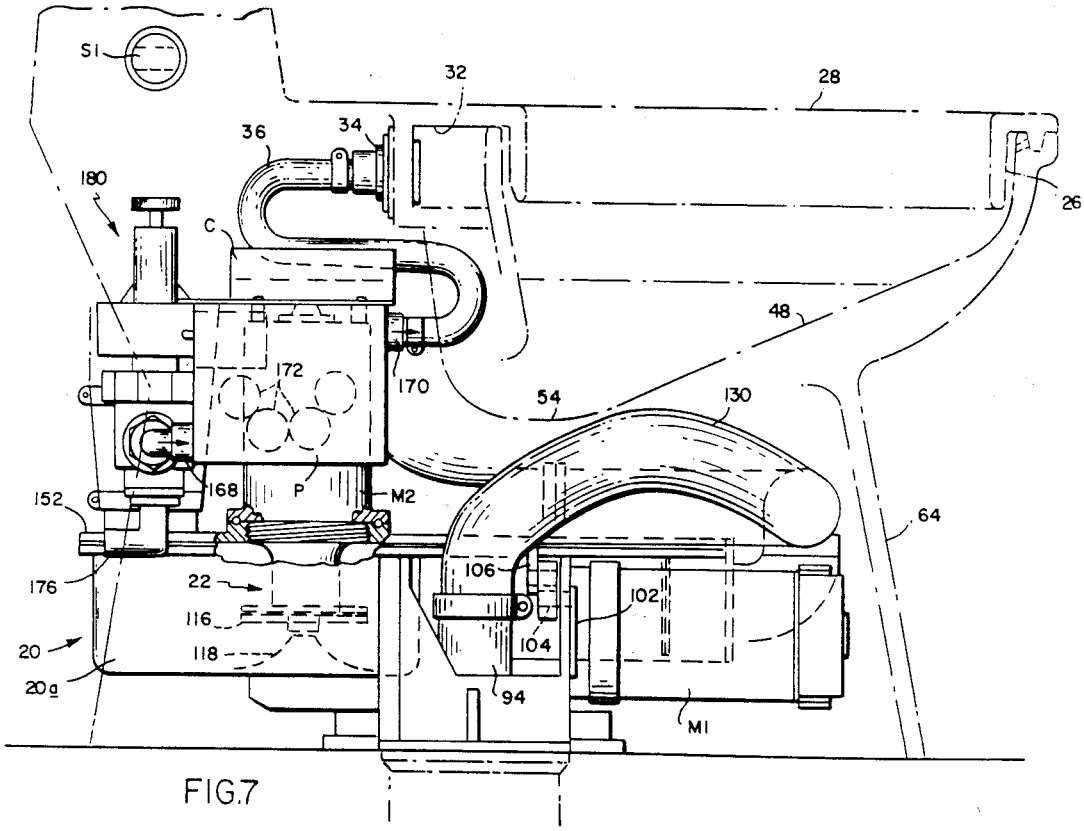
FIG. 7 is a side elevation of FIG. 5 showing the bowl in phantom.
Figure 14:
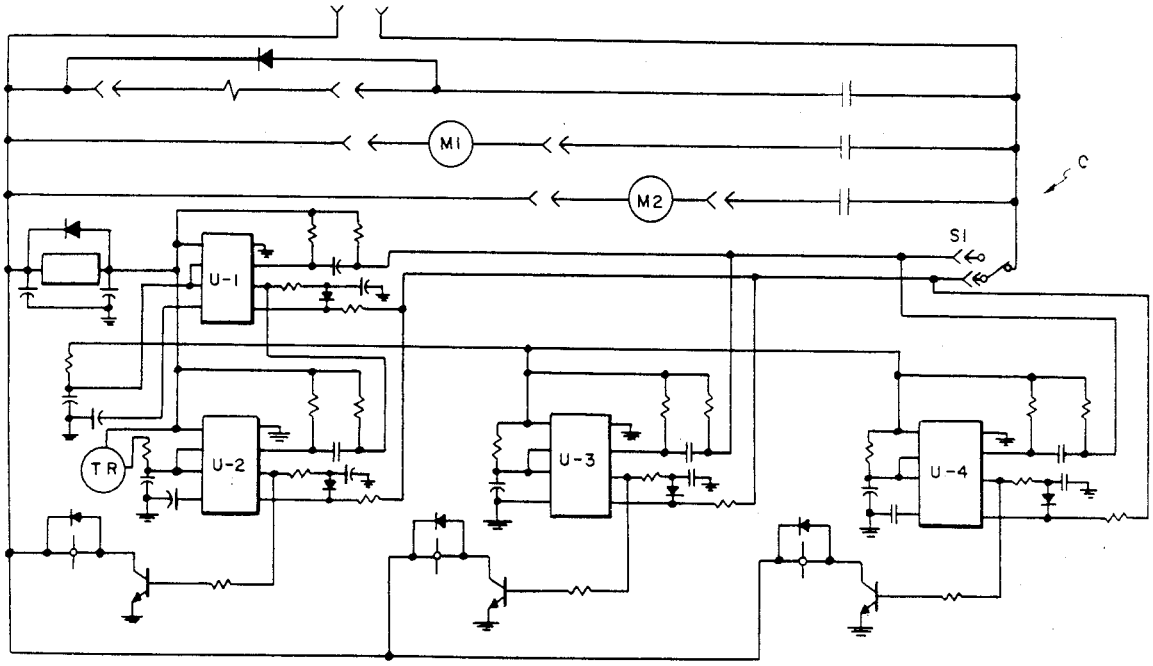
FIG. 14 is a diagram of a control circuit.

Referring to the drawings, the water saving toilet in one form is comprised essentially of two separable structures 10 and 12, the structure 10 comprising a bowl 14 and supporting structure 16 therefor, the latter being structured to define an enclosure for receiving the structure 12 and substantially concealing the same, and the latter comprising a chassis 18, FIG. 5, on which are mounted the operational components of the toilet comprising essentially an attrition tank 20; a hydraulic attrition impeller 22, FIG. 7; valve V, FIG. 1; pump 24, FIGS. 1 and 5, control circuitry C, FIG. 14; and plumbing as will be described hereinafter.

Figure 3:
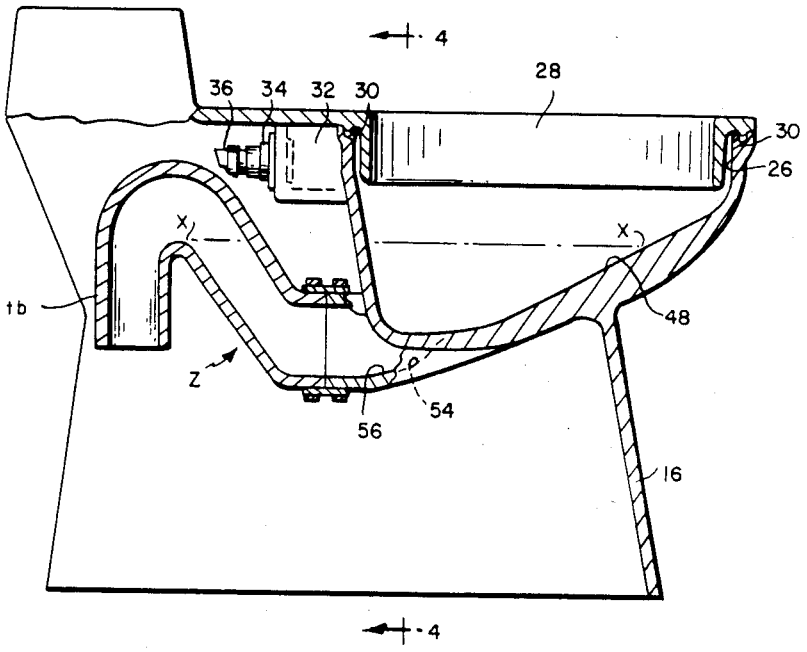
FIG. 3 is a vertical section taken on the line 3—3 of FIG. 2.
Figure 2:
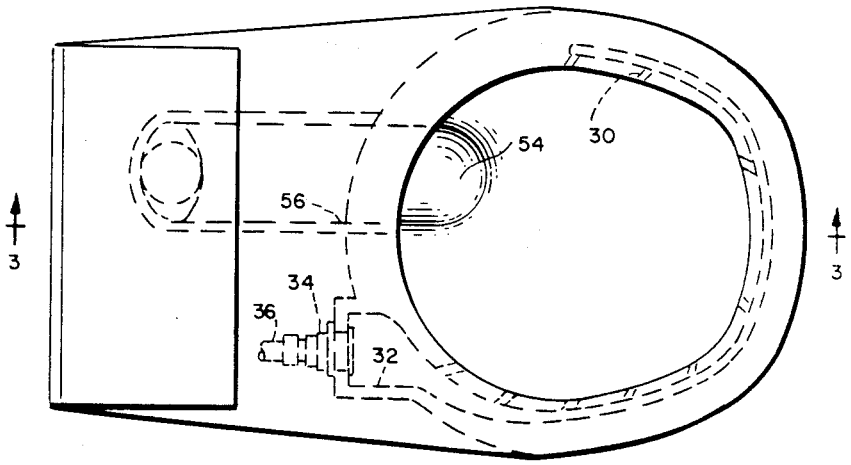
FIG. 2 is a plan view of the bowl.

The structure 10 comprising the bowl 14, as shown in FIG. 3, has a top opening 26 within which there is seated a ring 28. A plurality of flush ports 30 are provided at the top behind the ring through which flush water is adapted to be injected downwardly into the bowl. At the rear side of the bowl there is a manifold chamber 32 for supplying flush water to the ports 30 and this manifold is connected by a fitting 34 to one end of a flexible conductor 36, the opposite end of which is connected by way of the valve S to a source of flush water as will be described hereinafter.

Figure 10:
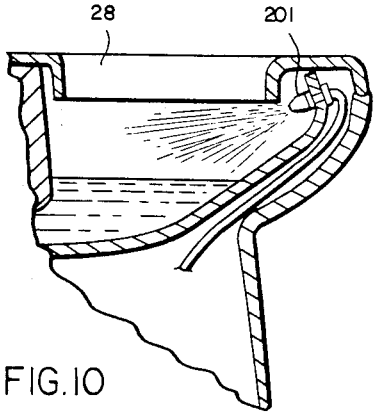
FIG. 10 is a fragmentary section of a modified bowl wherein a jet spray head is used to introduce water into the bowl.

Alternately, as shown in FIG. 10, a jet head 201 may be positioned at the front of the bowl so as to project water downwardly in a sheet over the surface of the bottom and the side walls of the bowl. The jet head 201 is located behind the ring 28 to prevent water from being directed upwardly. The jet head may be used in lieu of or in addition to the ports.

Figure 4:
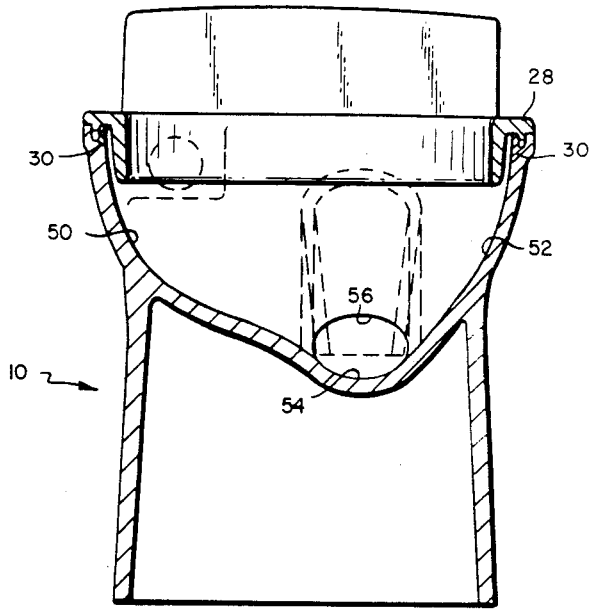
FIG. 4 is a vertical section taken on the line 4—4 of FIG. 3.
Figure 9:
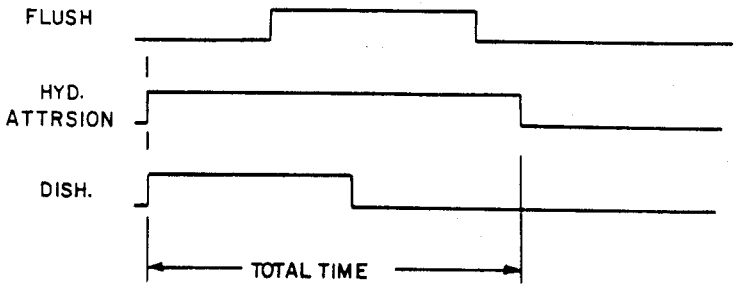
FIG. 9 is a diagram of a typical cycle of operation.

The bowl 14, as shown in FIGS. 3 and 4, has a sloping bottom 48 and sloping side walls 50 and 52 which slope toward the back of the bowl and optionally define at the bottom a well 54 which contains the outlet or discharge port 56. The slope of the bottom and side walls of the bowl augment, in conjunction with the downwardly projected flush water, movement of the solid portions of the effluent into a position to be forcibly withdrawn, that is, evacuated therefrom by the action of the discharge pump 24 as will be described hereinafter. A trap pipe Z is connected at one end by a suitable coupling to the discharge port 56 for maintaining the flush water in the bowl at a predetermined level X—X. The trap pipe at its junction with the well at the bottom of the bowl is elliptical and at its junction with the opening of the attrition chamber is circular. The cross section of the trap pipe changes progressively from elliptical to circular along the intake leg.

Figure 11:
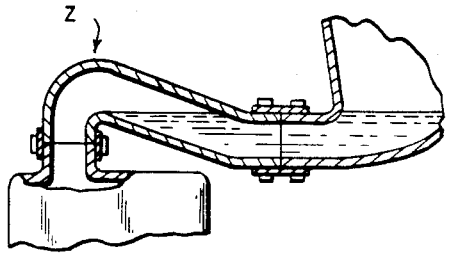
FIG. 11 shows a modified trap between the bowl and attrition chamber to lower the hydraulic head without sacrificing the seal.

The intake leg of the trap pipe shown in FIG. 3 has a relatively sharp upward slope, thus requiring that the pump overcome a relatively high static head to evacuate the effluent from the bowl. In order to reduce the head and, hence, the work for the pump and also to increase the rate of evacuation, the trap pipe as shown in FIG. 11 can be provided with an intake leg which has a relatively flat slope. The resistance to evacuation of the water from the bowl can thus be reduced to a minimum without forfeiting the seal between the bowl and the attrition chamber. However, a secondary seal is provided by the imposed loop in the discharge conductor 130, FIG. 1, and 268, FIG. 15.

As shown in FIGS. 1 to 9 inclusive, the supporting skirt 16 extends from the front of the bowl around the side and is open at the back so that the chassis and component parts supported thereby can be easily installed or removed and are accessible for adjustment and repair.

The operating components, as previously stated, are mounted on the chassis 18 and the latter is provided with flanges 72—72 containing holes 74—74. When the chassis is placed within the enclosure beneath the bowl proper, the flanges 72-71 at opposite sides of the chassis extend through openings 76—76 in positions to receive hold-down bolts not shown through the holes 70—70 and 74—74, thus securing both the operating components and the toilet bowl rigidly in place.

Figure 6:
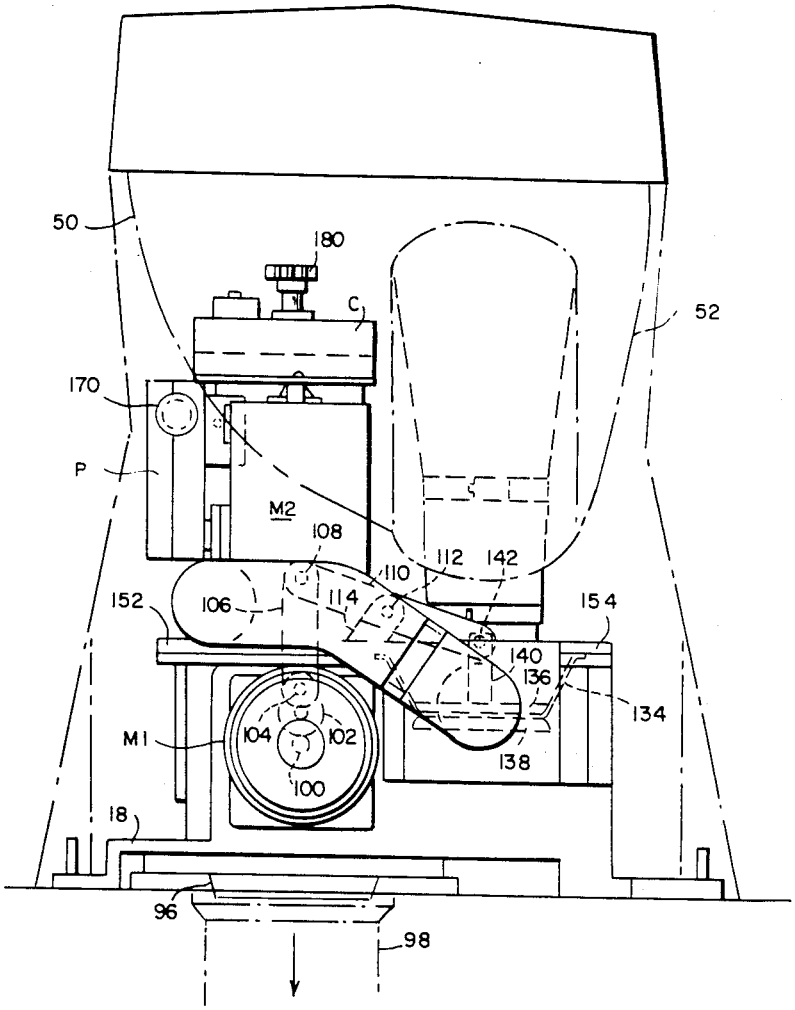
FIG. 6 is a front elevation of FIG. 5 showing the bowl in phantom.

Referring specifically to FIG. 5, the chassis 18 has formed integral therewith supporting structure comprising vertically-disposed, rectangularly-shaped supporting walls 80, 82, 84 and 86 and a partition wall 88 parallel to the wall 84 and extending from the wall 82 to the wall 86. Extending rearwardly from the wall 82 there are a pair of spaced, parallel walls 90 and 92. The upper edges of the respective walls 82,92 constitute a horizontal supporting surface. Within the structure, there is a vertically-positioned coupling 94. There is also mounted on the structure on the forward side of the wall 86 a motor M1. The shaft 100 of the motor extends through the wall into the structure and has fixed to it an eccentric 102 FIGS. 6 and 7 provided with a pin 104 located at a radial distance from the axis of the shaft 100. A link 106 is pivotally connected at one end to the pin 104 and at its other end by means of a pin 108 to one end of a rocker 110. The rocker 110 is pivotally mounted by means of a pin 112, a post 114 and is rocked by the motor M1 through the aforesaid linkage. The reciprocal distal end of the rocker 110 is pivotally connected to the displacement pump 24, as will be described hereinafter, for the purpose of pumping the treated effluent in the attrition chamber through a flexible conductor 130 connected at one end to the discharge side of the pump and at its other end to the coupling 94 and from thence to a soil pipe 98 in such a manner that a band or loop is imposed in the conductor 130 to provide a secondary seal.

Figure 8:
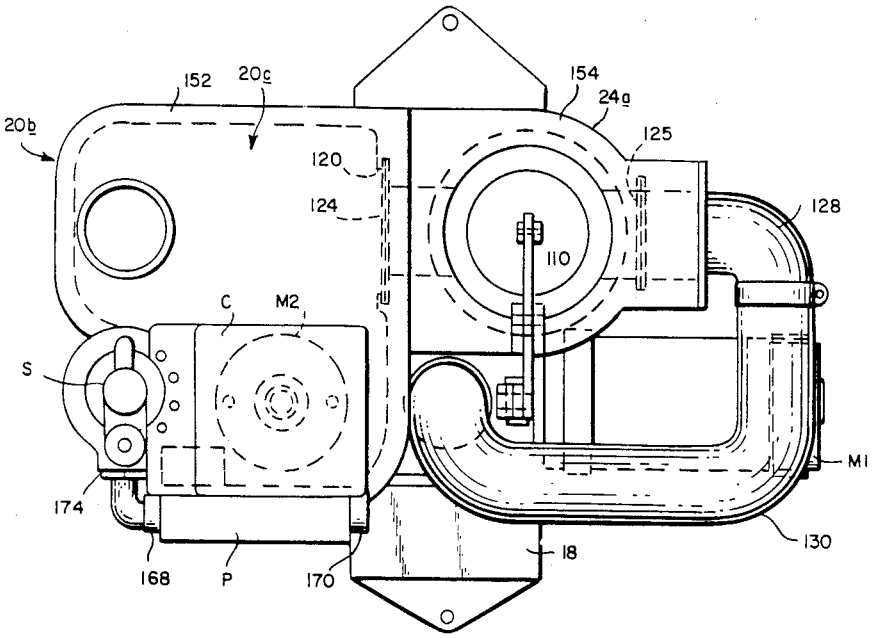
FIG. 8 is a top view of FIG. 5 omitting the bowl.
Figure 12:
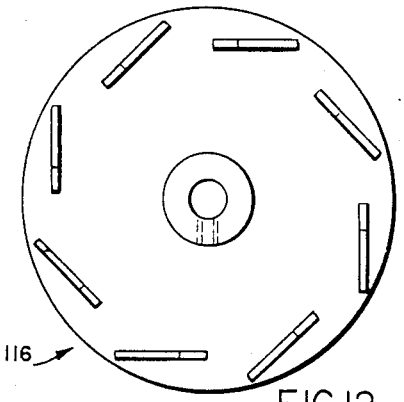
FIG. 12 is a plan view of a beater blade designed to effect hydraulic attrition.
Figure 13:
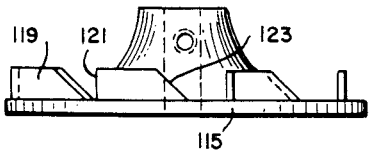
FIG. 13 is an elevation of the beater blade shown in FIG. 12.

The attrition tank 20, FIGS. 5 and 8, comprises an attrition chamber 20*a*, an intake chamber 20*b*, and a discharge chamber 20*c*. Within the attrition chamber 20*a* there is mounted the hydraulic attrition impeller 22, FIG. 7, comprising a blade 116 supported for rotation about a vertical axis in a position closely adjacent to the bottom, the latter being contoured to, in combination with the blade, effect hydraulic attrition of the solids in the effluent. A motor M2 provides for driving the blade. The blade 116 as shown in FIGS. 12 and 13 is designed to enable reducing the solids in the effluent and to disperse the fibers of the paper stock by hydraulic attrition to facilitate flow of the treated effluent and, hence, rapid disposal thereof with a minimum expenditure of energy. Apart from the contoured bottom in the area of the hydraulic attrition impeller, the remainder of the bottom is substantially flat.

The blade 116 as further shown in FIGS. 12 and 13 is a circular disk 115 provided at its center with a driving hub 117 which is fixed to the motor shaft and has on its upper surface a plurality of circumferentially positioned beater blades 119 having perpendicular and inclined edges 121 and 123. The blade herein shown is exemplary, but not intended to be limiting, since blades of other configuration may be employed to effect hydraulic attrition.

A cover 152, FIG. 5, bolted to the top of the attrition chamber supports the motor M2 and is provided for this purpose with a threaded opening 153 for removably receiving a threaded extension 155 of the motor housing so that when the motor is screwed into the opening, the motor shaft and blade 116 fixed thereto will be supported in the attrition chamber above the bottom. Thus, it is possible to easily remove the blade from the chamber for repair and/or for the removal of foreign objects from the attrition chamber. The cover 152 also contains an opening to which one end of a flexible conductor 156 is connected for transmitting effluent from the bowl to the attrition chamber. The other end of the conductor 156 is connected to the trap pipe Z. A supporting structure, FIG. 1, defining a horizontal platform 160 and a vertical panel 162 is mounted on the cover 152 to provide support for the controls C, valve V and pulsator P.

The pump 24 also mounted on the chassis comprises a pump chamber FIG. 8. At diametrically opposite sides of the pump chamber there are valve assemblies 124 and 125 which connect the pump chamber to the discharge chamber 20*c* and to an elbow 128 which, in turn, is connected by the flexible conductor 130 to the coupling 94. The valve assemblies 124 and 125 are one-way valves so arranged that, during the suction stroke, the valve 124 opens to permit effluent to be withdrawn from the attrition chamber and the valve 125 closes. On the pressure stroke the valve 124 closes and the valve 125 opens. The pump 124 is a diaphragm pump provided with a diaphragm 134, FIG. 6, supported at its edges within the pump chamber. The central portiom of the diaphragm is confined between two rigid disks 136 and 138, FIG. 6 above, and below the diaphragm clamped to each other to operate in conjunction like a piston. The disk 136 is provided with a stem 140, the upper end of which is pivotally connected by means of a pin 142 to the distal end of the rocker 110. Rocking movement of the rocker will thus move the diaphragm up and down within the pump chamber so as to withdraw treated effluent from the attrition chamber.

A cover 154 is bolted to the top of the pump chamber and contains an opening 164 for the linkage which connects the diaphragm of the pump to the motor M1.

The pulsator P, FIGS. 7 and 8, is in the form of a rectangular chamber containing an inlet opening 168 and a discharge opening 170 and has internally thereof a plurality of spherical balls 172 which produce a pulsation of the water flowing through the chamber. The pulsating effect of the water or the jets is to produce intermittent impact on the surfaces of the bowl to clean and scour the surfaces.

The pulsator is connected by means of the flexible conductor 36 to the manifold 32. A coupling 174 connects the pulsator P to the valve V which, in turn, is connected to a suitable source of water through a pipe 176. The valve V, when actuated, supplies water from a source of water to the pulsator and from thence to the bowl through the jet ports when a flushing cycle is initiated. The valve V is illustrated herein as a solenoid-operated valve. However, any commercially available or power-operable valve may be used for this purpose.

A water pressure sensor Ps is provided to vary the length of time that the valve V remains open to ensure an optimum flush level of the water in the bowl.

In operation, a cycle commences with the actuation of a flush button S1, FIG. 14, which simultaneously starts the motor which drives the hydraulic attrition impeller, M2 and the motor M1 which drives the discharge pump. Hydraulic attrition of the effluent in the attrition chamber and discharge of the disseminated effluent from the attrition chamber commence before any flush water is supplied to the bowl. At a predetermined time after the discharge pump and attrition impeller have been started, flush water is supplied to the bowl in a predetermined quantity. A desired volume for one flushing is 2–3 quarts. However, a larger volume of water may be used where there is less scarcity of water, for example, as much as 5–6 quarts of water may be used with a considerable economy in the use of water as compared with conventional toilets where a single flushing requires 14½ to 28 quarts. The flush water is introduced while treated effluent is being discharged so that there is an overlap in operation during which flush water is being introduced and treated effluent is being discharged and the rate of introduction and discharge is timed and controlled so that just as much of the treated effluent is discharged as flush water is introduced at any given time. The discharge of the treated effluent is terminated first, followed by termination of the introduction of flush water. Hydraulic attrition is continued throughout discharge of the treated effluent and terminated after supplying of water to the bowl and the introduction of the flush water has been terminated. Specifically, FIG. 9 but not to be limiting, a typical time cycle is 12½ seconds; flushing begins 4 seconds after the cycle is initiated and terminates 7 seconds after it is initiated and discharge continues for a period of 7 seconds, commencing when the cycle is initiated and terminating at the end of 7 seconds. Hydraulic attrition continues throughout the entire 12½ seconds.

The sequence of operation during a cycle of operation ensures a positive removal by evacuation of the effluent from the bowl as distinguished from conventional displacement of effluent by the introduction of the flush water since the operation does not depend upon the introduction of the water to the bowl to effect flushing. Evacuation is also assisted by the slope at the bottom and side walls of the bowl, the direct or pulsating delivery of the flush water to the bowl, and by the elliptical configuration of the trap. A constant volume of flush water and a constant volume of discharge is maintained in the system so that there is a continuity of fluid from the bowl to the attrition chamber.

The discharge pump 24 is especially adapted to handle effluent without becoming clogged since there are no closely associated valves or pistons or other interfering structure and, in addition, is designed to be easily removed for inspection and cleaning when necessary.

The valve V is provided with a manually-adjustable control 180 to enable metering the flush water to the bowl in the desired quantity, depending upon the water pressure.

Referring to the control circuit diagram, FIG. 14, the switch S1 is a toggle or snap switch which, when actuated, moves from full line position to the dotted line position and back to the full line position. Actuation of the switch S1 initiates operation of the macerator motor M1 and the discharge motor M2 through circuitry designated U3 and U4. This circuitry remains energized when the switch S1 returns to its full line position and continues to remain energized until de-energized by timers in the respective circuits. A delay circuit designated U1 is also energized by the switch S1 and is effective following a predetermined interval of time to effect operation of flushing circuitry designated U2 which, in turn, energizes the flush valve V which supplies flush water to the bowl. At the end of a predetermined time, a timer TR de-energizes the circuit. A cycle of operation is commenced by actuating the snap or toggle switch S1 which operates to simultaneously energize the circuitry U1, U3 and U4, the circuitry U3 and U4 operating to simultaneously start the pump motor and the macerator motor and the circuitry U1, following a period of 4 seconds, operating to energize the flush valve V. At the end of 7 seconds, the timer TR deenergizes the circuitry U4; at the end of 11 seconds, a timer de-energizes the circuitry U2 and, at the end of 12½ seconds, a timer de-energizes the circuitry U3.

Figure 17:
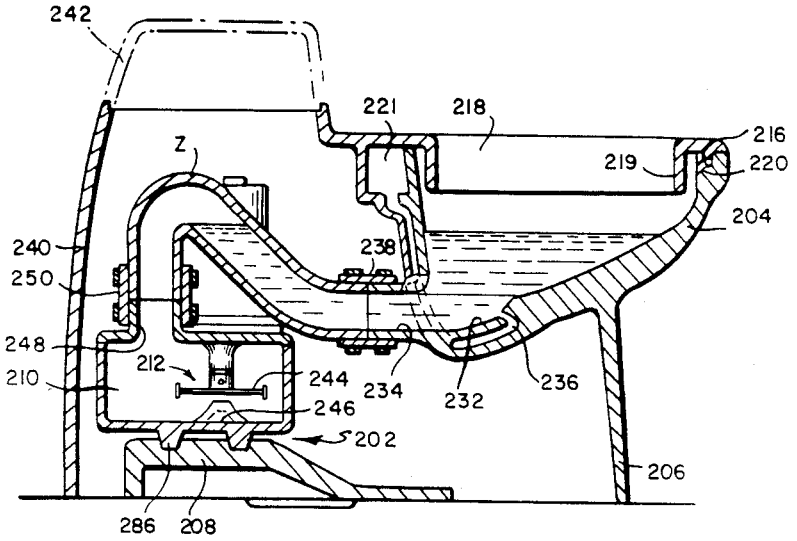
FIG. 17 is a vertical section taken on the line 17—17 of FIG. 16.

An alternative form of the toilet system is shown in FIGS. 15 to 21 inclusive and, referring thereto, comprises essentially two structures 200 and 202, FIG. 17 the structure 200 comprising a bowl 204 and supporting structure 206 therefor and the structure 202 comprises a chassis 208 on which there are mounted the operational components of the toilet comprising essentially an attrition tank 210, a power-driven hydraulic attrition means 212 (FIG. 17), a power-driven pump 214 (FIG. 19), control circuitry C (FIG. 14) and plumbing as will be described hereinafter.

Figure 16:
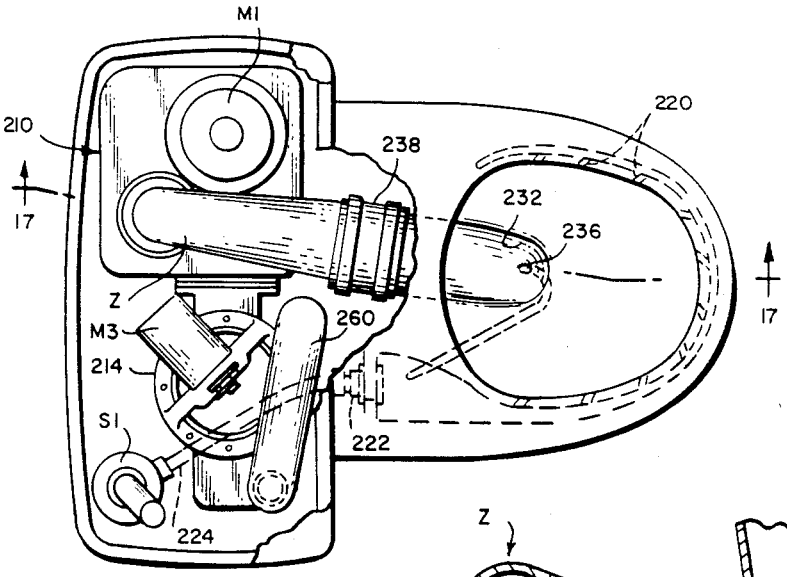
FIG. 16 is a plan view of FIG. 15 showing the bowl in full lines.
Figure 15:
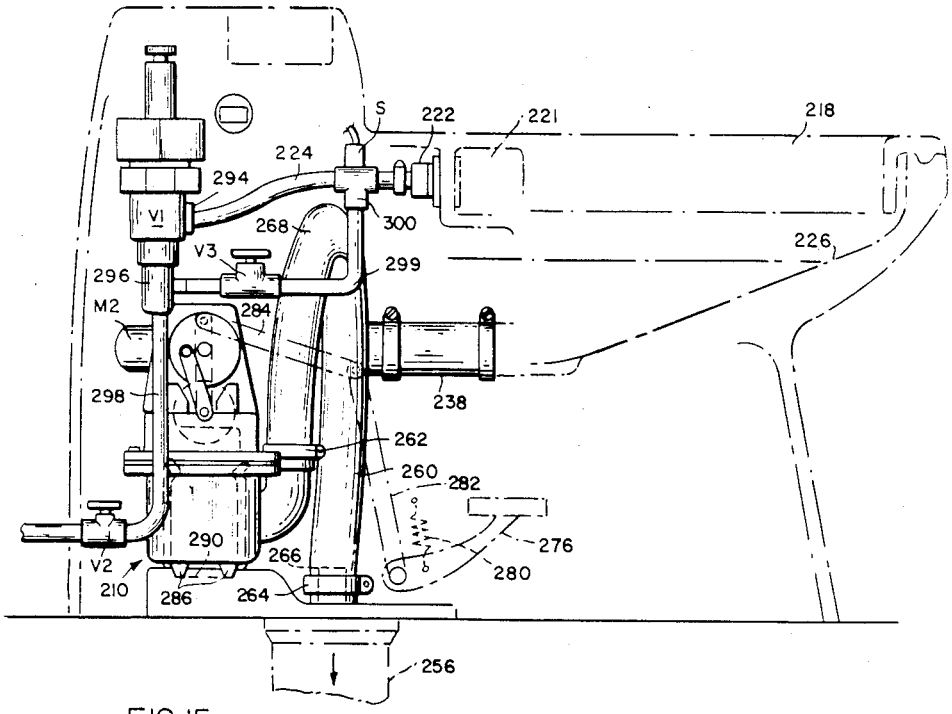
FIG. 15 is an elevation of a modified form of the toilet system shown in FIGS. 1 to 9 inclusive with the bowl and support therefor shown in phantom.

The structure 200 comprising the bowl 204, as shown in FIGS. 15 and 16, has a top opening 216 within which there is seated a ring 218. The ring 218 has a downwardly-projecting flange 219 and the bowl is provided with a plurality of flush ports 220 located behind the flange 219 through which the flush water is adapted to be injected into the bowl. At the rear of the bowl there is a manifold chamber 221 for supplying flush water to the ports 220 and this manifold is connected by a fitting 222 and T 300, FIG. 15, to one end of a flexible conductor 224, the opposite end of which is connected to a source of flush water by way of a valve V1, conductor 298 and valve V2 as will be described hereinafter.

The bowl 204, as shown in FIGS. 15, 16 and 17, has a downwardly-sloping bottom wall 226 and downwardly-sloping side walls 228 and 230 which slope toward the back of the bowl and define at the bottom a well 232 which contains an outlet or discharge port 234. The sloping surface of the bottom and side walls of the bowl augment, in conjunction with the projection of the flush water into the bowl, movement of the solid portions of the effluent in the well into a position to be forcibly withdrawn, that is, evacuated therefrom by the action of the discharge pump as will be described hereinafter. To further augment discharge, a flush water port 236 is provided in the well to which flush water is supplied directly through duct 223 from the manifold 221 to assist in propelling the solid matter from the well through the discharge port 234.

Figure 18:
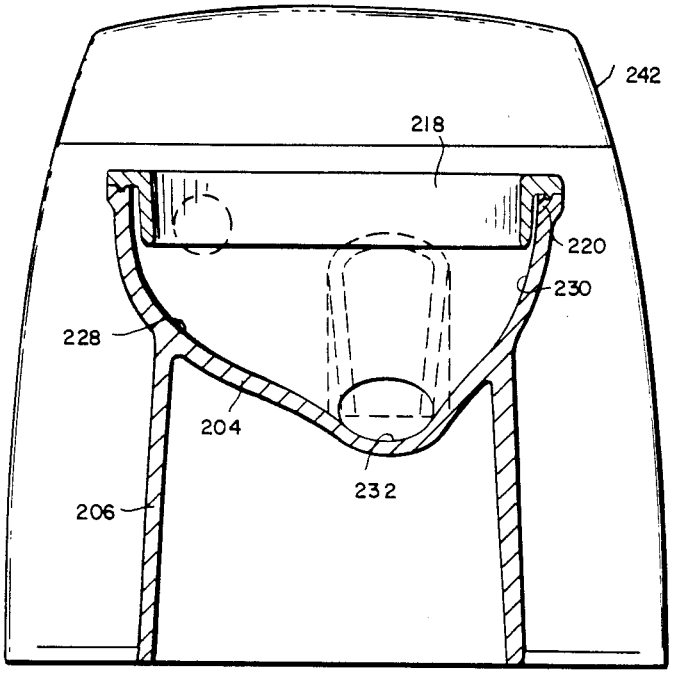
FIG. 18 is a rear view of FIG. 17.

A trap pipe Z is connected at one end by a suitable coupling 238 to the discharge port 234 for maintaining the flush water in the bowl at a predetermined level X—X. The trap pipe at its junction with the well at the bottom of the bowl is elliptical, as shown in FIG. 18, and this configuration continues upwardly from the bowl to the apex at the top where it becomes circular and is circular from there down to the attrition chamber.

In the form of the invention shown in FIGS. 15 to 17, the support 206 for the bowl extends from the front of the bowl around the sides to form an enclosure 240 for the structure 202 of the toilet. The top of the enclosure 240 is provided with a removable cover 242, FIG. 18, shown in dot and dash lines which may be removed to provide access to the operating components and the circuitry. Optionally, the entire rear portion may be removed to provide access to the operating components.

The structure 202 comprises, as shown in FIGS. 15, 16, 18 and 19, the attrition tank 210 which is a substantially rectangular attrition chamber. Within the attrition chamber there is mounted for rotation about a vertical axis an impeller blade 244 for effecting hydraulic attrition. The impeller blade 244 is driven by a motor M3 removably mounted in an opening at the top of the attrition chamber. This may be accomplished by threading as shown in FIG. 7 or other quick release attaching means. Directly below the impeller blade 244 there is a truncated mound having a toroidal surface 246 which, in conjunction with the blade, ensures hydraulic attrition of the solid matter delivered into the attrition chamber from the bowl. The attrition chamber contains a top opening 248 which is connected by a coupling 250 to the vertically-extending leg of the trap Z.

Figure 20:
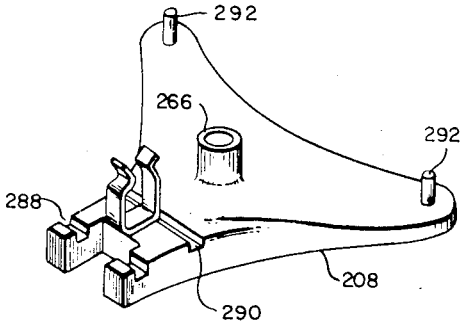
FIG. 20 is a perspective of a supporting chassis for the operating components shown in FIG. 15.

The attrition chamber is mounted on the chassis 208 by means of downwardly-projecting lugs 286, FIG. 17 which mate with notches 288,290, FIG. 20, on the chassis which hold the tank in place on the chassis.

Figure 21:
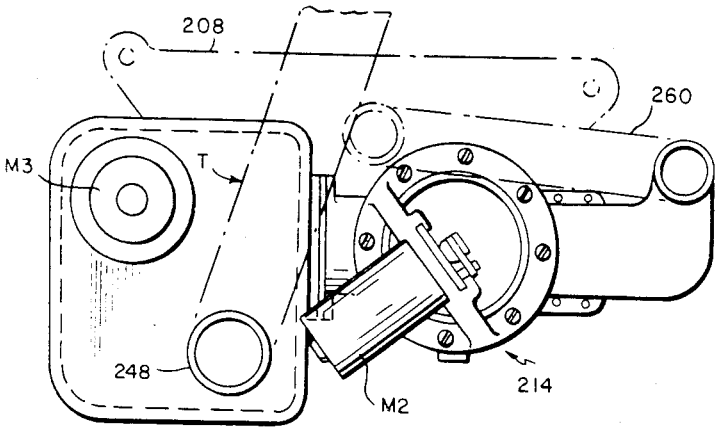
FIG. 21 is a plan view of FIG. 19 showing the chassis of FIG. 20 in phantom.
Figure 19:
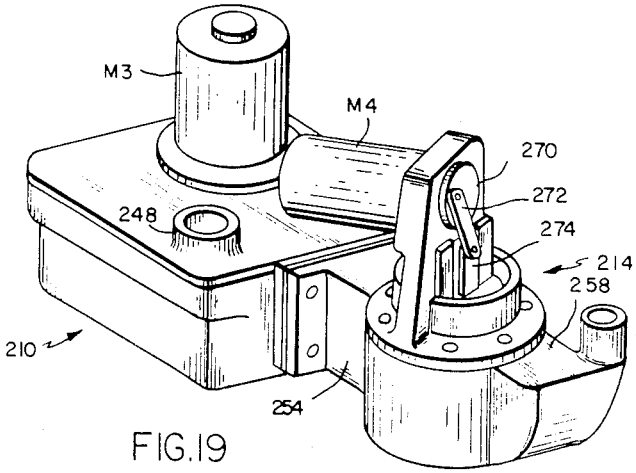
FIG. 19 is a perspective view of the operating components of the system shown in FIGS. 15, 16, 17 and 18 removed from the bowl.

The structure 202 also includes the pump 214, FIGS. 16 and 19. The intake side of the pump is connected by a conductor member 254 to an opening in one side of the attrition chamber for withdrawing effluent after it has been subjected to the hydraulic attrition from the attrition chamber and delivering it to a waste pipe 256, FIG. 15. To this end, the discharge side 258 of the pump is connected to one end of a flexible conductor 260 by a coupling 262, the opposite end of which is connected by a coupling 264 to a nipple 266 fixed on the chassis, FIG. 20. As herein illustrated, the flexible conductor 260 is formed into a loop 268 so as to provide a trap between the pump and the waste pipe 256. The pump as shown in FIGS. 19 and 21 is a diaphragm pump which is driven by a motor M4 by way of an eccentric 270, link 272 and stem 274, the latter being fixed to the diaphragm. To provide for operating the pump independently of a motor in the event that the motor fails, there is provided a foot treadle 276, or, optionally, a hand lever, FIG. 15, pivoted at 278 and normally supported in an inoperative position by a spring 280 which is operable by depression by way of links 282 and 284 to rotate the eccentric 270.

The plumbing for supplyihg flush water to the toilet bowl comprises the valve V1, FIG. 15, which may be a solenoid-controlled valve having an outlet port 294 connected to the flexible conductor 224 and an inlet port 296 connected to one end of the conductor 298, the other end of which is connected by way of the valve V2 to a source of clean water. The valve V2 is a shutoff valve. A bypass conductor 299 is connected at one end by way of a shutoff valve V3 with the valve V1 and at its other end by the T 300 with a coupling 222 so that, in the event that the valve V1 becomes inoperative, flush water may be supplied to the bowl by means of the shutoff valve V3. A sensor Sr is provided at the T 300 responsive to the pressure of the water flowing through the valve V1 to control the time during which the valve V1 stays open so as to ensure an optimum level of fluid in the bowl.

In operation, the toilet system described in FIGS. 15 to 21 inclusive is the same as that described in FIGS. 1 to 9 inclusive, hence, it is considered that it is not necessary to redescribe the sequence of its operation. As in the first described form of the invention, an important criterion is to use a minimum quantity of water in the disposal of the effluent. In operation, the pump evacuates the contents of the bowl from the bowl into the attrition chamber and, at the same time, discharges the macerated effluent from the attrition chamber into the soil pipe. Since the flushing cycle is the same as that shown in FIG. 9, the operation of which was described heretofore when describing the form of the invention shown in FIGS. 1 to 9, it is deemed that it is not necessary to redescribe the circuitry for this alternative form of the invention.

It may be desirable to operate the toilet system described herein as a dry bowl rather than a wet bowl. This can be accomplished by changing the timing of the operation of the flush water inlet valve and the pump so that the supply of water to the bowl is cut off soon enough so that the pump will evacuate all of the effluent and water supplied to the bowl from the bowl before it stops.

It should be understood that the present disclosure is for the purpose of illustration only.

What is claimed is:

1. The method of disposing of effluent in a toilet system with a minimum expenditure of flush water wherein the toilet system comprises a bowl, a valve for supplying flush water to the bowl, an attrition chamber to which the effluent in the bowl is transferred by a motor-driven discharge pump connected to the attrition chamber and motor-driven hydraulic attrition means within the attrition chamber for effecting hydraulic attrition of the solid matter of the effluent comprising maintaining a predetermined level of water in the bowl and a predetermined level of effluent in the attrition chamber and effecting a sequential operation wherein a predetermined volume of treated effluent is pumped from the attrition chamber into a waste pipe and a corresponding volume of flush water is delivered to the bowl, and wherein pumping the effluent from the attrition chamber effects an evacuation of the effluent from the bowl.

2. A method according to claim 1 comprising pumping effluent from the attrition chamber prior to supplying flush water to the bowl.

3. A method according to claim 1 comprising effecting hydraulic attrition of the effluent in the attrition chamber throughout the cycle of operation.

4. A method according to claim 1 comprising pumping effluent from the attrition chamber after terminating the supply of water to the bowl.

5. A method according to claim 1 comprising commencing the hydraulic attrition operation with initiation of the discharge and terminating the hydraulic attrition after the supply of flush water has been terminated.

6. A method according to claim 1 comprising employing a diaphragm pump having its intake side connected to the attrition chamber so as to withdraw effluent from the attrition chamber during the suction stroke and discharge effluent into a waste pipe on the pressure stroke.

7. A method according to claim 1 comprising removing the effluent and flush water from the bowl by operation of the intake stroke of a diaphragm pump, the intake side of which is connected to the attrition chamber and discharging it to a waste pipe by the operation of the pressure stroke of the diaphragm pump.

8. A method according to claim 1 wherein no more than 5–6 quarts of water are used.

9. A method according to claim 1 wherein 2–3 quarts of water are used.

* * * * *